United States Patent [19]

Grant

[11] Patent Number: 4,861,112

[45] Date of Patent: Aug. 29, 1989

[54] APPARATUS FOR CLEANING ALUMINUM CELLS

[75] Inventor: Louis A. Grant, Pittsburgh, Pa.

[73] Assignee: Louis A. Grant, Inc., Pittsburgh, Pa.

[21] Appl. No.: 224,315

[22] Filed: Jul. 26, 1988

[51] Int. Cl.[4] ..... E21C 3/00; E21C 11/00

[52] U.S. Cl. ..... 299/70; 15/104.1 C; 137/355.24; 173/34; 182/128; 212/269

[58] Field of Search ..... 299/70; 15/104.1 C; 173/32, 33, 35, 34, 43; 266/281; 212/205, 230, 264, 267, 269; 182/128; 104/248; 105/215.1; 137/355.2, 355.24

[56] References Cited

U.S. PATENT DOCUMENTS

| | | | |
|---|---|---|---|
| 3,084,921 | 4/1963 | Grant | 165/5 |
| 3,346,300 | 10/1967 | Grant | 299/70 |
| 3,370,654 | 2/1968 | Skendrovic | 173/34 |
| 3,389,755 | 6/1968 | Grant | 173/44 |
| 3,458,396 | 7/1969 | Grant | 173/35 |
| 3,586,113 | 6/1971 | Grant | 173/34 |
| 3,800,965 | 4/1974 | Barron et al. | 212/267 X |
| 4,239,291 | 12/1980 | Skendrovic | 299/70 |

FOREIGN PATENT DOCUMENTS

| | | | |
|---|---|---|---|
| 2424645 | 1/1975 | Fed. Rep. of Germany | 299/70 |

*Primary Examiner*—Stephen J. Novosad
*Assistant Examiner*—David J. Bagnell
*Attorney, Agent, or Firm*—Webb, Burden, Ziesenheim & Webb

[57] ABSTRACT

Apparatus for cleaning accumulated spent alumina, dross, aluminum pads, refractories and carbon rods from an aluminum cell including a first platform supported on outrigger members for spanning the open top of the aluminum cell. The ends of the outrigger members carry edge clamping and traveler devices thereon which are alternately activated by hydraulic cylinders. In a locked position, the outrigger arms resist lateral and upward forces imposed by the digging and cleaning tools of the apparatus. In an unlocked position, the traveler devices support the outrigger members on an adjacent surface for movement along the cell. A turntable carrying a second platform is rotatably mounted on the first platform to permit 360° rotation of the second platform. A mounting head is pivotally mounted on the second platform and carries an elongated extensible boom for controlled 360° rotation about the longitudinal axis of the boom. A forward end of the boom includes a hydraulic cylinder for effecting pivotal movement of a detachable tool such as a hydraulic chipping hammer or a bucket scoop.

14 Claims, 5 Drawing Sheets

APPARATUS FOR CLEANING ALUMINUM CELLS

BACKGROUND OF THE INVENTION

1. Field of the Invention

The present invention relates generally to apparatus for cleaning accumulated spent alumina, dross, aluminum pads, refractories and carbon rods from an aluminum cell at the end of a campaign and more particularly to apparatus for breaking up the spent alumina, dross, aluminum pads, refractories and carbon rods in an aluminum cell and subsequently removing the broken-up material from the cell.

2. Description of the Prior Art

Prior art apparatus for cleaning aluminum cells utilize pneumatic chipping heads at the end of a boom, but the apparatus does not have the versatility of movement necessary to loosen the material from both the side walls and the bottom of the cell. The prior apparatus also has only limited movement and therefore has the same problems as the chipping apparatus.

SUMMARY OF THE INVENTION

The invention is directed to apparatus for removing accumulated spent alumina, dross, aluminum pads, refractories and carbon rods from Soderberg electrolytic aluminum cells. The apparatus includes a first platform supported on outrigger supports which rest on the opposite edges of the cell and which are clamped to the edges of the cell in a first position by hydraulic cylinders or frame while the apparatus is in operation. The outrigger clamps maintain the apparatus in the desired position relative to the cell and resist the lateral and upward forces caused by contact between the apparatus and the material in the cell. In a second position, the hydraulic cylinders unclamp the outrigger supports and lower rollered traveling gear to permit longitudinal movement of the apparatus along the cell without the aid of a lifting crane. A turntable is rotatably mounted on the upper surface of the first platform, and a second platform is mounted on the turntable so that the second platform can rotate through approximately 360°. A multi-part, elongated, extensible boom is mounted on the first platform so that the boom can be rotated along with the platform to position the end of the boom in any desired working location.

In one mode the forward end of the boom supports a hydraulic chipping hammer carrying a chisel tool to loosen the spent material and carbon rods adhered to the side walls and the bottom of the cell and break the material into pieces small enough to be removed. In a second mode the forward end of the boom carries an attachment bucket to remove the loosened and broken-up material from the cell and deposit it in a truck or other receptacle for removal from the site. The boom is rotatable about its longitudinal axis and is pivotally attached to the rotatable platform so that the chipping hammer and the bucket can attack spent material and carbon rods on both the walls and the bottom of the cell. The boom is extensible and retractable relative to the second platform in order to facilitate positioning the chipping tool and the bucket. The chipping head tool and the attachment bucket are also pivotally mounted on the free end of the boom the movement of which is controlled by a hydraulic cylinder. Hence, the chipping head and the bucket have three degrees of movement to assure complete and rapid access to all areas of the cell walls and bottom. The movement of the boom and of the tool carried on the forward end thereof is preferably controlled by a pendant control on the end of an umbilical cord so that the operator is removed from the immediate vicinity of the cell while the apparatus is operating. The pendant control preferably includes stainless steel solenoids which provides trouble free operation even if magnetic fields are present.

Further features and other objects and advantages of the invention will become clear from the following detailed description made with reference to the drawings wherein like reference characters refer to like parts.

DESCRIPTION OF THE PREFERRED EMBODIMENT

The following description of the preferred embodiment of the invention is directed to an apparatus having a chipping hammer on the forward or free end of the boom. However, it will be understood by those skilled in the art that the movement of the boom and the mechanism for causing movement of the boom and the chipping hammer are the same regardless of the type of tool mounted on the end of the boom.

Figure 1:
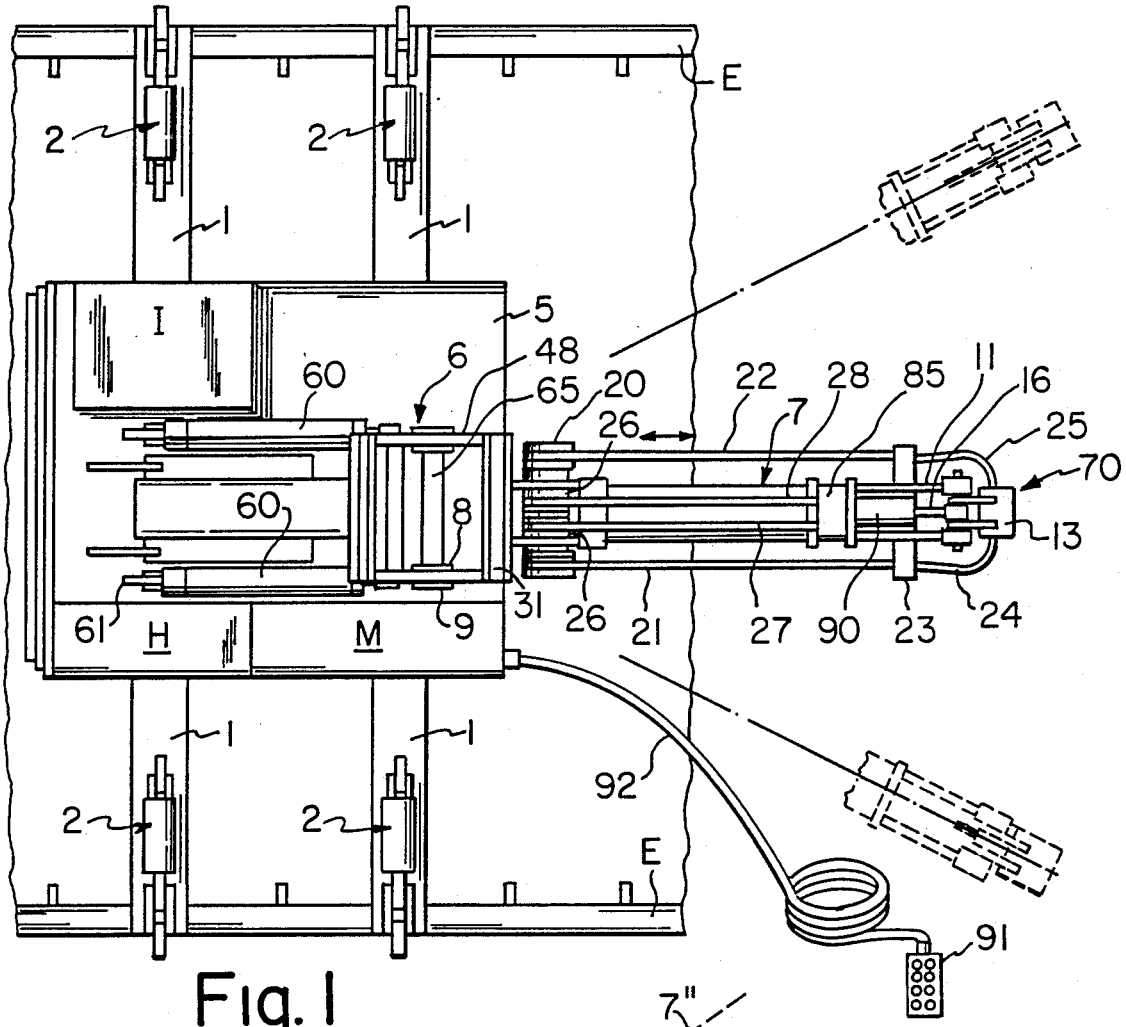
FIG. 1 is a plan view of the apparatus with the boom in a partially extended position showing a chipping hammer attached to the free end of the boom.
Figure 2:
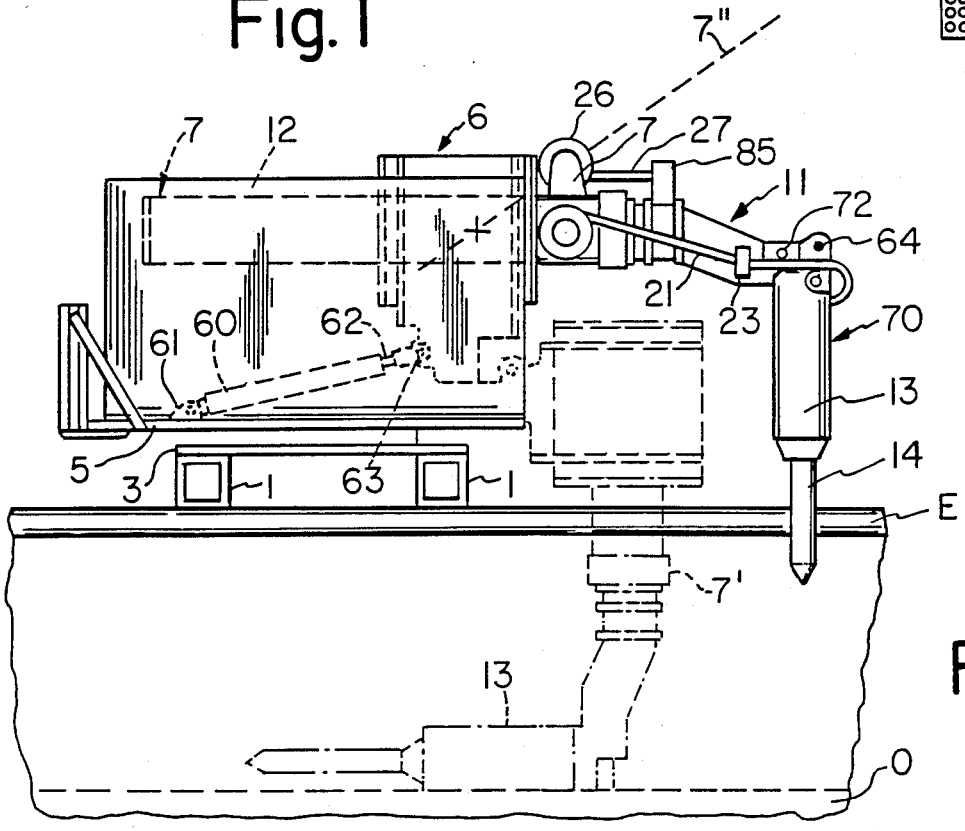
FIG. 2 is a side elevation of the apparatus showing the chipping hammer perpendicular to the cell bottom in solid lines and parallel to the cell bottom in phantom lines.
Figure 3:
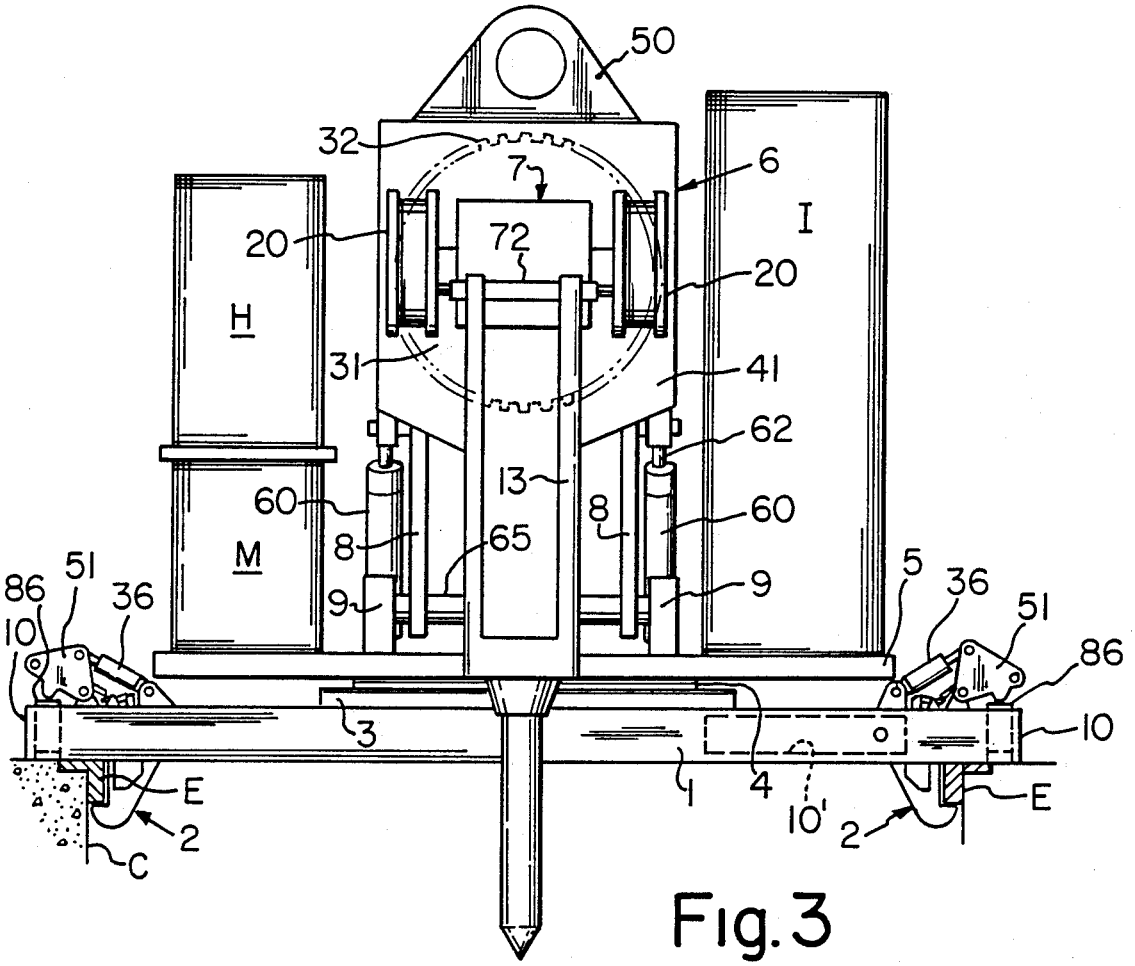
FIG. 3 is a front elevation of the apparatus with the chipping hammer perpendicular to the cell bottom.

With reference to FIGS. 1–3 of the drawings, the apparatus has a pair of spaced substantially parallel outrigger members 1 which are adapted to extend across the width of an aluminum pot cell C. A clamp 2 is located on the outer end of each outrigger member to firmly clamp the apparatus in place on the opposed edges E of a cell during operation. The outrigger members 1 are made of square tubing, and each end is telescoped outwardly to the length necessary to span the width of the cell being cleaned. The telescoping ends 10 of the outriggers are shown schematically in FIG. 3 of the drawings. One or both of the ends 10 have square beam inserts 10' for sliding movement within the interior of member 1.

A first stationary platform 3 is located at the center portion of the spaced outriggers 1, and a turntable 4 is mounted on the upper surface of the stationary platform 3. A second rotatable platform 5 is fixedly mounted on the top of the turntable 4, and a mounting head 6 which supports the extensible boom 7 is mounted on the rotatable platform 5. The platform 5 also has a housing M which supports an electric motor or diesel engine. The housing M also encloses the hydraulic valves and control circuits. The platform also supports a heat exchanger H and a hydraulic tank l which supply the power for operating the apparatus.

The mounmting head 6 has a rearwardly directed lug 8 attached at each side thereof, and the lower end of each lug 8 cooperates with an upstanding spaced lug 9 which is attached to the upper surface of the platform to pivotally mount head 6 on the platform 5. A pivot bar 65 extends through aligned holes 64 in the lower end of each lug 8 and in the upper end of each spaced lug 9 to create the pivotal connection between mounting head 6 and platform 5. Thus, the boom and the attached tool can be pivoted through a 90° arc downwardly from the horizontal position shown in solid lines in FIG. 2 of the drawings into the vertical position shown in phantom lines 7'. In addition, the boom 7 and its attachment can be pivoted upwardly through about a 30° arc above horizontal as shown by line 7'' to permit bucket loading of a truck, for example.

Figure 6:
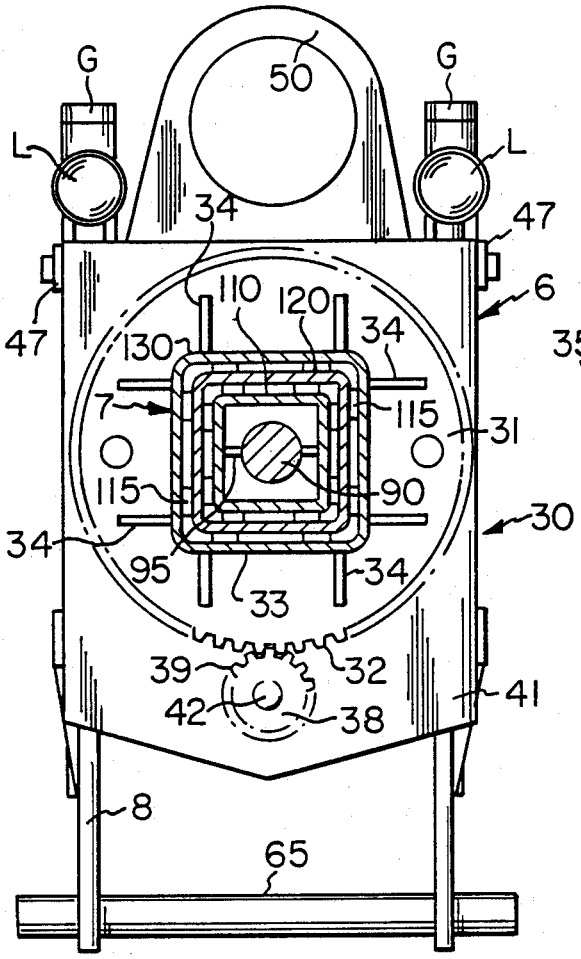
FIG. 6 is a front elevation of the boom support mechanism with the boom shown in cross section.
Figure 7:
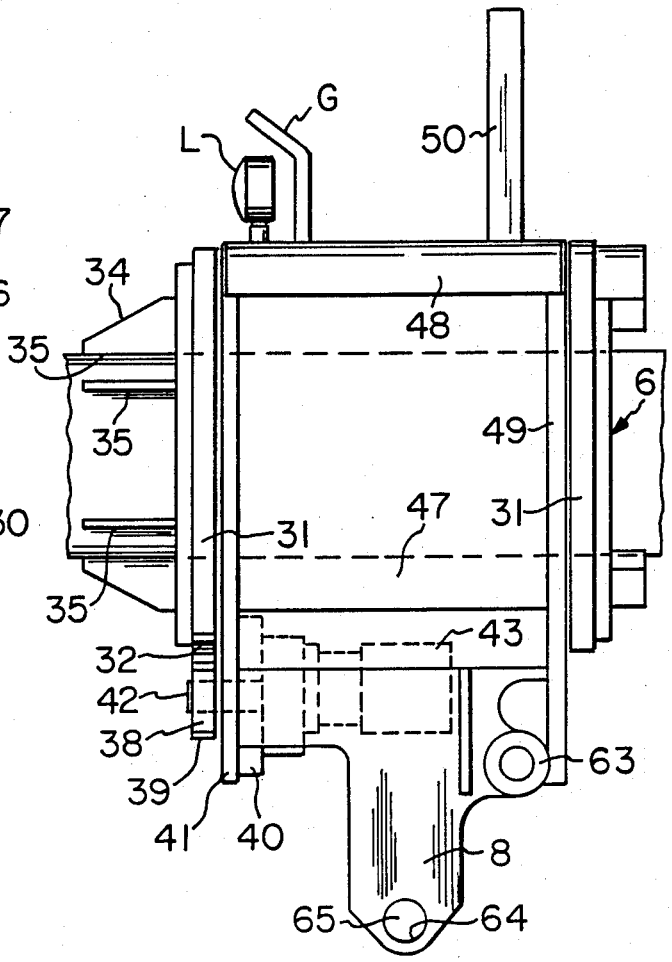
FIG. 7 is a side elevation of the boom support mechanism.
Figure 10:
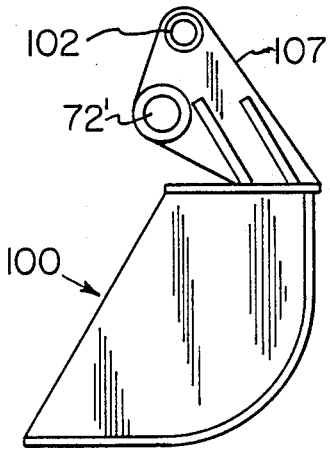
FIG. 10 is a side elevation of the bucket shown in FIG. 4.
Figure 11:
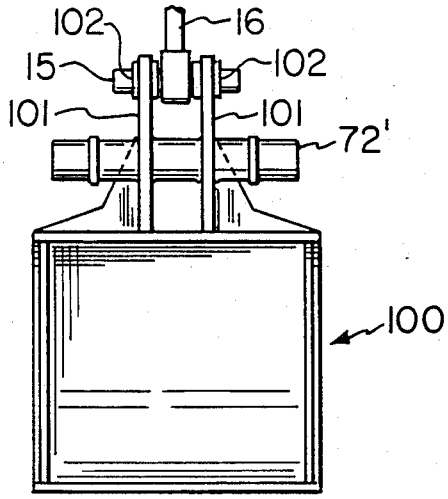
FIG. 11 is a front elevation of the bucket of FIG. 10.

The extensible boom 7 projects into mounting head 6 having a forward portion 11 located ahead of the mounting head 6 and a area portion 12 located within and rearwardly of mounting head 6. The portion of boom 7 which is located within mounting head 6 is supported in a cylindrical drum-like member 30 to permit rotation of the boom about its longitudinal axis. The drum-like member and the other details of the mounting head 6 are shown in FIGS. 6 and 7 of the drawings. The drum-like member 30 is constructed of a pair of spaced, apertured plate members 31 which are connected for simultaneous rotation. Each plate 31 is supported by bearings (not shown) in the mounting head 6, and the forward plate has its outer edge formed with gear teeth 32 which function like a ring gear when the boom is to be rotated. A substantially square apertured opening 33 is formed in the center of each of the plates 31 to receive the outer sleeve member 130 of boom 7. A plurality of rigid stiffener members 34 are welded to plate 31 around the periphery of opening 33, and the exterior of the outer sleeve member is attached to edge 35 of stiffener 34 to support the outer sleeve in plate 31. The gear teeth 32 on plate 31 are driven by a pinion gear 38, having teeth 39, which is mounted on a shaft supported in a standard bearing 40 supported on the lower end of a front plate 41 forming part of mounting head 6. The pinion gear shaft 42 is driven by an electric motor 43 mounted on mounting head 6 as shown in FIG. 7 of the drawings. The mounting head 6 also has side members 47 and top member 48 which are attached to front plate 41 and a rear plate 49 to form a rigid housing to support the boom 7. A lifting lug 50 is welded to top member 48. Lifting lug 50 may also include a hinged attachment means (not shown) so as to permit it to be retracted during periods of non-use. The apparatus also preferably includes a pair of headlights L with lamp guards G positioned at the forward end of the mounting head 6 to assist the operator in viewing shadowed or other dark areas within the pit-like cell C.

With specific reference to FIG. 2 of the drawings, it will be seen that the mounting head 6 can be pivoted downwardly 90° from a vertical orientation to a horizontal orientation. Such movement will also pivot boom 7 and a tool carried on the free end of the boom into the position shown in phantom line 7' or upwardly to position 7''. Pivoting of mounting head 6 is affected by a pair of spaced hydraulic cylinders 60 which are pivotally attached to spaced lugs 61 on platform 5 and have rods 62 pivotally attached to spaced eyelets 63 on lugs 8 on the mounting head 6. Each of the spaced depending lugs 8 on the mounting head has an eyelet 64 formed therein, and a pivot bar 65 extends through the eyelets into lugs 9 fixed on platform 5 so that upon extension and retraction of rods 62 by cylinders 60, the mounting head 6 is pivoted about pivot bar 65.

Figure 8:
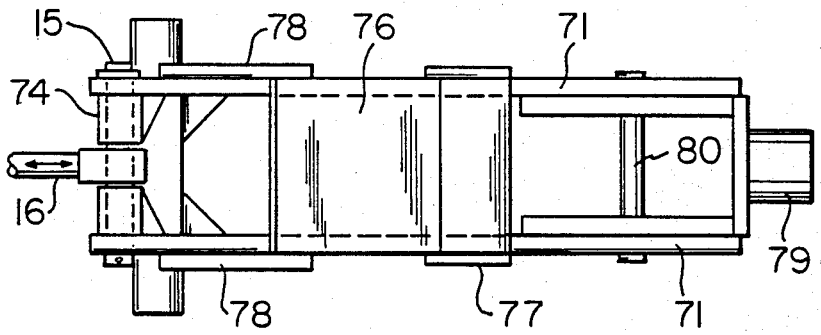
FIG. 8 is a plan view of a tool connector carried on the free end of the boom.
Figure 9:
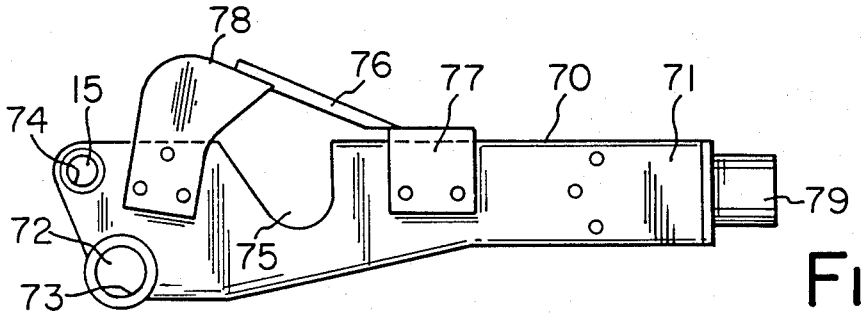
FIG. 9 is a side elevation of the tool connector shown in FIG. 8.

A holder 70 for holding hammer 13 is shown in FIGS. 8 and 9. THe brakcet is pivotally connected to the end of the forward portion 11 of boom 7. The holder 70 has a pair of spaced parallel arms 71 which are attached by a pivot shaft pin 72 to the end of the forward portion 11 of boom 7. Forwardly of a pair of spaced pivot shaft openings 73 and 74, each arm 71 has a depression 75 to receive the hydraulic hoses to operate the hammer 13. A rearwardly angled shield 76 is attached to a bracket 77 fixed to the arms 71 to protect the hydraulic lines and the connections between the valves and the hoses for the hydraulic fluid. A side guard 78 is also attached to the outer face of each arm 71 to protect the hydraulic valves and hose connection (not shown). A hardened peripheral face piece 79 is located at the front end of tool holder 70, and a pin 80 extends between arms 71 behind face 79 to be received in an opening in the hydraulic hammer to position the hammer within the holder 70. In this way, the hammer is firmly held against the face piece 79 at the forward end of the tool holder.

The outer ends of the arms 71 of the hammer holder 70 are pivotally connected by pivot shaft 72 to the end of the forward portion 11 of the boom. A reciprocating rod 16 from a hydraulic cylinder 90 extends from the boom 7 and is pivotally attached to a pivot pin 15 located at the rear end of the arms 71 in aligned bushings 74 spaced adjacent to the pivot shaft 72 in order to rotate the chipping hammer 13 about the axis of the shaft 72 to position the chisel 14 in the proper location to attack the material to be removed from the cell. The axis of the chisel may be positioned parallel to the axis of the boom, at 90° to the axis of the boom or at any angle less than 90°. The chipping hammer is removable from the end 11 of the boom 7 when desired by removing the pivot shafts 15 and 72 between the arms and the hammer so that the scoop-type bucket 100 can be pivotally attached to the ends of arms as shown in FIG. 3 of the drawings.

The rod 16 for pivotally moving the chipping hammer is extended from hydraulic cylinder 90 which has its rearward end pivotally attached by pins 95 to a mounting bracket located within the hollow inner boom member 110, FIG. 6. The hollow inner boom member 110 fits within the intermediate boom member 120 and is extended therefrom to increase the length of the overall boom assembly 7.

After the material in the cell is completely loosened by the chisel 14 on the hydraulic hammer 13, the hammer is replaced by the scoop-type bucket 100 which is attached to the end of the forward portion 11 of the boom 7 by a pivot shaft 72'. The rear of the bucket has a pair of spaced lugs 101, and the pivot pin 15 extends through aligned holes 102 in the lugs so that the bucket can be rotated about the pivot shaft 72' between a scooping or loading position and an unloading position upon reciprocal movement of a connected piston rod 16 from the hydraulic cylinder 90.

Figure 4:
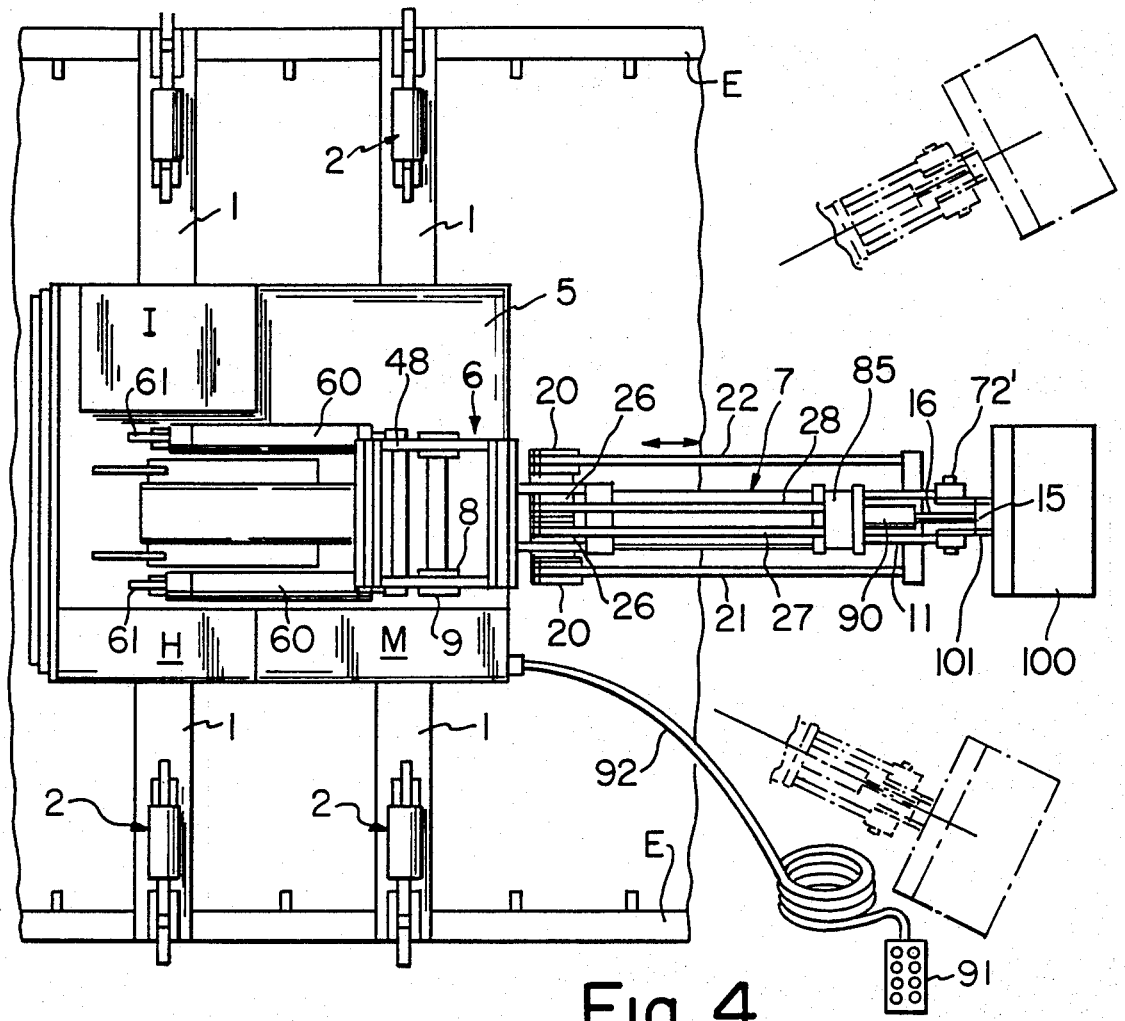
FIG. 4 is a plan view of the apparatus showing a bucket attached to the free end of the boom.

As seen in FIGS. 1, 2 and 4 of the drawings, the boom 7 is extensible and retractable as the forward portion 11 is moved in the digging and scooping modes. As previously described, the cylinder 90 and the chipping hammer 13 are hydraulically actuated and, therefore, require hydraulic fluid hoses to supply the necessary power input thereto. A pair of spring loaded hose reels 20 are each mounted on opposed sides of the boom 7 adjacent the mounting head 6 to cause automatic extension and retraction of the hoses corresponding to the extension and retraction of the boom. Rubber hydraulic hoses are coiled thereon to provide a hydraulic fluid input hose 21 which extends from the reel 20 to a hose fitting 23 mounted at the end of the forward portion 11 of the boom 7. A return reel mounted hydraulic hose 22 extends outwardly to a like hose fitting 23 mounted on the opposed outer end portion of the boom. The movable hydraulic hoses 21 and 22 are connected at the fittings 23 to an inlet hose 24 and an outlet hose 25, respectively, to complete the hydraulic circuit required for motivation of the hammer 13, FIG. 1. When the hammer 13 is removed from the end 11 of the boom and replaced by the bucket 100, as shown in FIG. 4, the previously described hoses 24 and 25 are removed from the quick disconnect fittings 23, since the bucket 100 requires no additional hydraulic fluid supply other than the pivoting motion supplied by the cylinder 90. The hydraulic fluid circuit to the cylinder 90 is established by way of a first supply hose 27 and returned by a second hose 28 both of which are retractably housed on a pair of vertically aligned hose reels 26 mounted above the boom 7 adjacent the mounting head 6. The forward ends of the hydraulic hoses 27 and 28 are attached to a fitting box 85 which is mounted on the forward end of the boom. the box 85 contains conventional hose fittings (not shown) for completing the hydraulic circuit with the cylinder 90 in a known manner. The hydraulic fluid is supplied to and withdrawn from the reels 20 and 26 through stationary central hub portions thereof (not shown) which are in communication with the hoses 21, 22, 27 and 28. Hydraulic fluid from the hoses is circulated through the hydraulic tank H in conventional fashion. As the boom 7 is retracted or extended, the spring loaded reels 20 and 26 will play out additional hose or take up slack hose so as to maintain a substantially linear and somewhat taut hose configuration.

Figure 12:
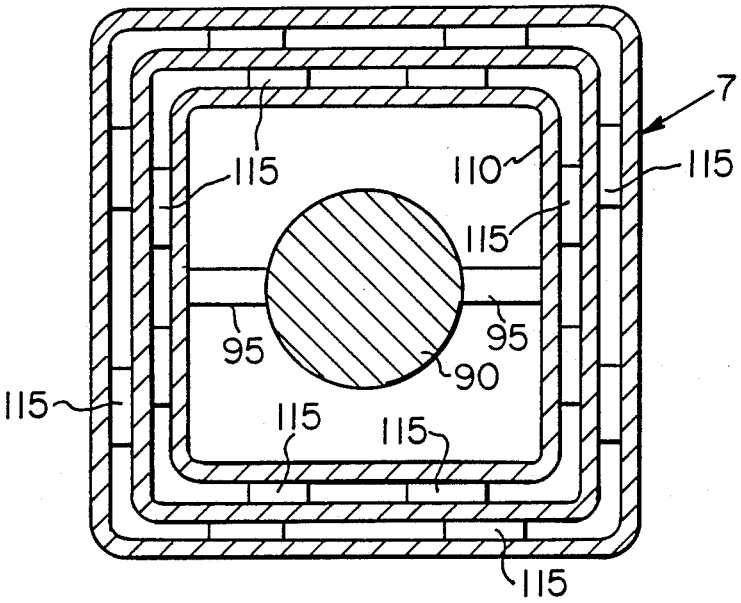
FIG. 12 is a cross section of the extensible boom.

The extensible boom 7, as seen in cross section in FIGS. 6 and 12 of the drawings, comprises three generally square sections which are telescopically nested within one another. An outer boom member 130 is secured to the mounting head 6 by a plurality of stiffener members 34. An intermediate boom member 120 is positioned within the outer member 130 and an inner boom member 110 is nested within the outer two members. The hydraulic cylinder member 90 is pivotally mounted at one end to the inner boom member 110 by way of a pair of laterally extending pivot pins 95. The intermediate boom member 120 and the inner boom member 110 are slidably moved with respect to one another by conventional hydraulic cylinders (not shown) and have a plurality of brass bushings 115 positioned therebetween to maintain a uniform spacing between the boom surfaces. A plurality of brass bushing spacers 115 are also positioned between the inner surface of the outer boom member 130 and the outer surface of the intermediate boom member 120.

Figure 5:
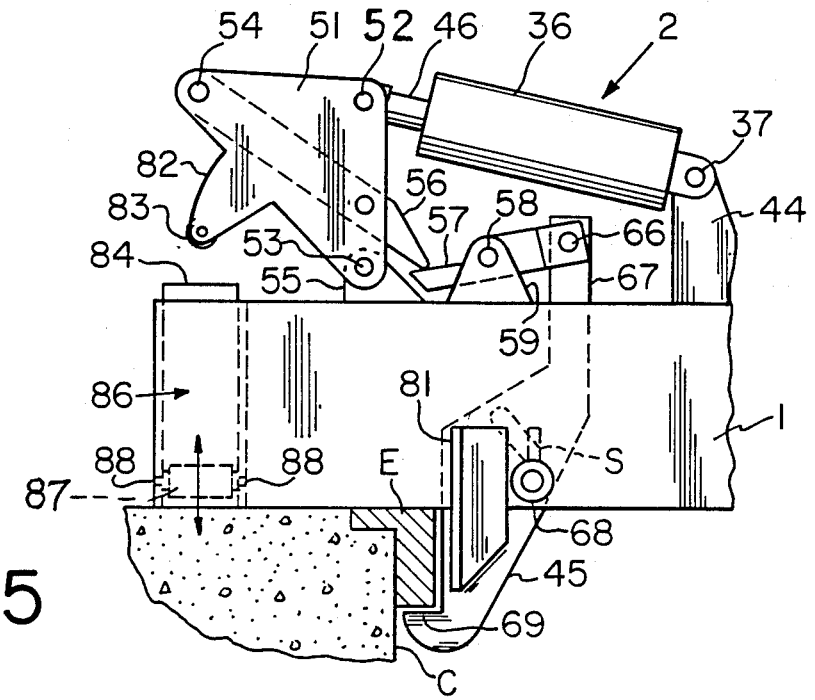
FIG. 5 is a side elevation of a clamp on the end of an outrigger member.

Referring now to FIG. 5 of the drawings, each of the hold-down clamps 2 carried by the outrigger members 1 includes a hydraulic cylinder 36 which functions to actuate and engage a hook-shaped clamp 45 when in a first position and to release the clamp 45 and subsequently engage a roller device 86 when the cylinder 36 is in a second position. The hydraulic cylinder 36 is pivotally connected at one end at eyelet 37 to a mounting flange 44 carried by the outrigger member 1. A piston rod 46 of the hydraulic cylinder 36 is pivotally connected at its forward end to a pivot plate 51. Pivot plate 51 has a generally triangular shape and is connected to the piston rod 46 at a first corner 52 of the triangular shape. The plate 51 is also pivotally connected at a second corner 53 to a mounting flange 55 extending from an upper surface of the outrigger member 1. An elongated bar 56 is pivotally connected at one end to a third pivot point 54 at a corner of plate 51. The distal end of the bar 56 engages a lever arm 57 which is pivoted on a pin 58 for movement about its center. Pin 58 is anchored on a mounting web 59 supported on the upper surface of the outrigger member 1. The distal end of the lever arm 57 is pivotally connected at pin 66 to an upper arm portion 67 of the hook-shaped clamping member 45. The clamping member 45 also is loosely received for slidable and pivotal movement within slots 5 formed therein for movement on a headed guide shaft 68 which is attached to the outrigger member 1. When the hydraulic cylinder 36 is in the retracted or first position shown in FIG. 5, the plate 51 causes the bar 56 to engage and press downwardly against the lever arm 57. This, in turn, forces the clamp 45 to move upwardly along the slot 5 whereby the jaw or hook section 69 of the clamp 45 tightly engages the lower edges E of the aluminum cell C. In this manner, the lateral and upward forces generated by the digging head 13 as well as by the shovel 100 when they engage the material in the cell C are counteracted by the clamped engagement of the jaws 69 so as to maintain the outrigger arms 1 in position on the edges of the aluminum cell during use. Otherwise, the outrigger members 1 could shift to a position where the device can become dislodged from the edges of the cell and fall into the interior thereof. The outriggers 1 also have an outwardly extending angle iron face plate 81 weldably secured to each of the clamp members 45 which provide a gross stopping surface as the outrigger members are fitted to a particular cell width.

When the machine is required to be moved longitudinally along the edges of the aluminum cell, each of the hydraulic cylinders 36 is activated to the extended position wherein the piston rod 46 moves outwardly from the retraced position shown in FIG. 5. In the extended position, an outwardly projecting finger portion 82 depending from a hypotenuse face of the pivot plate 51 engages the top surface 84 of a travel roller assembly 86 which is housed for slidable vertical movement within the end of each outrigger member 1. The finger 82 carries a rotatably mounted bearing member 83 at its distal end for rolling engagement with the surface 84 of the roller assembly. The roller travel assembly 86 includes a cylindrical roller 87 rotatably mounted by way of shafts 88 within the assembly 86. Downward movement of the pivot plate 51 causes a disengagement of the clamping jaw 69 from the cell edge E and a concurrent downward movement of the roller assembly 86 whereupon, in a fully extended position, the travel roller 86 engages the upper surface of the wall of the aluminum cell C. The force generated by the cylinders 36 at each of the distal ends of the outrigger members 1 is sufficient to cause the outrigger members 1 to be lifted upwardly away from the upper surface of the aluminum cell walls whereby the entire weight of the machine is rollably supported by the rollers 87. In this manner, the machine can be longitudinally moved along the upper surface of the aluminum cell walls to be repositioned thereon for further work.

In use, the apparatus is initially lifted by a crane, for example, attached to the lifting trunnion 50 and positioned above the pit-like cell C. After the clamping devices 2 have been activated the apparatus is ready to perform a diggin function or a shoveling function depending upon which tool is in place at the end of the boom. The apparatus is controlled by an operator who stands a distance from the edge of the cell utilizing a control pendant 91 of which is attached to circuit control means located within the hydraulic valve and mmotor housing M by way of a flexible electrical power cable 92. In this manner, the operator is able to position himself away from the apparatus or, if desired, at a position adjacent the digging site to assure an accurate and efficient digging or scooping operation. The power calbe is preferably manually coiled at the exterior of the machine and is of a length sufficient to ensure a travel distance for the operator at least as long as the travel distance of the boom 7. The control pendant preferably contains solenoid devices made of stainless steel which permits the use of the control pendant in the magnetic field which surround aluminum pot cells.

Having thus described my invention with the detail and particularity required by the Patent Laws, what is claimed and desired to be protected by Letters Patent is set forth in the following claims.

I claim:

1. Apparatus for removing frozen aluminum, spent alumina, dross, aluminum pads, refractories and other accumulated materials from an open top pit-like cell having an interior bounded by a bottom, vertical side walls bordered by a peripheral edge and a floor surface adjacent said peripheral edge, and end walls, said apparatus comprising:

a. a plurality of outrigger members adapted to span the open top of the cell and having extensible outer end portions adapted to rest on said floor surfaces;

b. means associated with the outer end portion of each of said outrigger members for clamping said outrigger members to said peripheral edges of the side walls of said pit-like cell when said means is in a first position and for releasing said clamping action and engaging a roller means when in a second position to rollably support said outrigger members on said floor surfaces for travel therealong;

c. a mounting head positioned above said outrigger members including means for pivotally and rotatably supporting said mounting head on said outrigger members;

d. extensible and retractable boom means for movement along a longitudinal axis;

e. means for mounting said boom means within said mounting head for rotative movement about the longitudinal axis of said boom means;

f. tool means for one of digging and removing loosened material from said cell;

g. means for detachably and pivotally mounting said tool means to the end of the forward portion of said boom means;

h. hydrualic actuation means and control means for selective movement of said tool means within and above the pit whereby three degrees of freedom of motion of said tool means are achieved.

2. The apparatus of claim 1 wherein each of said clamping and travelling means associated with the end of an outrigger member comprises a hydraulically actuated cylinder attached at one end to the outrigger member and including a piston rod pivotally attached at a terminal end to a pivot plate pivotally mounted on the outrigger member, linkage means attached to said outrigger member and engageable with said pivot plate and with a clamping jaw pivotally carried by said outrigger member when said hydraulic cylinder is in a first, retracted position whereby said clamping jaw is adapted to engage said edge of the pit-like cell.

3. The apparatus of claim 2 wherein said clamping and traveling means further comprises a roller assembly movably positioned within the outrigger member and having an upper surface portion, said pivot plate having an outwardly extending projection which is adapted to engage said upper surface and move said roller assembly in a downward direction when said hydraulic cylinder is in a second, extended position, whereby said pivot plate first disengages said linkage means and said clamping jaw from engagement with the pit peripheral edge and then activates said roller assembly to a position wherein said roller assembly supports the apparatus on said floor surface for travel therealong.

4. The apparatus of claim 1 wherein said outrigger members are constructed of square tubing and include end portions which telescope outwardly, whereby pit-like cells of varying widths are accommodated thereby.

5. The appartus of claim 1 wherein said boom means includes an outer boom member having a square tubular shape, attached to said mounting head; an intermediate boom member telescopingly received within said outer boom member for slidable movement therein; and an inner boom member telescopingly receiving within said intermediate boom member for slidable movment therein; and including bushing means positioned between said outer boom and intermediate boom members and between said intermediate and inner boom members for spacing said boom members and to provide a bushing surface to permit relative sliding action therebetween.

6. The apparatus of claim 5 wherein said inner boom member carries a hydraulically actuated cylinder at a forward end thereof for pivotally moving said tool means mounted at the end thereof.

7. The apparatus of claim 6 wherein said tool means is a hydraulically actuated chipping hammer.

8. The apparatus of claim 6 wherein said tool means is a scoop-type bucket.

9. The apparatus of claim 6 including the hydraulic actuation means for said cylinder including a plurality of spring biased reels rotatably mounted on said outer boom member, each of said reels carrying a hydraulic hose extending from said reel to a forward end of the inner boom member adapted for attachment to said hydraulic cylinder for pivotally moving the tool means, whereby said reels maintain a tension on said hydraulic hoses as said boom members are extended and retracted to respectively play out and reel in said hoses in response to said boom movements.

10. The apparatus of claim 1 wherein the control means includes a portable control pendant electrically connected to said apparatus by a movable power cable for control of said apparatus from a remote location.

11. The apparatus of claim 1 including means for lifting said apparatus to and from the pit-like cell.

12. The apparatus of claim 11 wherein the lifting means comprises an apertured lug secured to the mounting head adapted to detachably receive a crane hook therein for lifting said apparatus.

13. The apparatus of claim 1 wherein the means for rotatively mounting said boom means within the mounting head includes an aligned pair of apertured plates rotatably mounted on opposed sides of said mounting head to fixedly receive said boom means within said apertures; at least one of said apertured plates including a ring gear thereon operably coupled to a pinion gear and to a motor shaft for controlled rotation of said boom means by a motor positioned within said mounting head.

14. The apparatus of claim 1 wherein the means for pivotally and rotatably supporting said mounting head include a first stationary platform fixed to said outrigger members, a second rotatable platform mounted on said first stationary platform for 360° rotation thereon, said mounting head including a pair of spaced lugs mounted thereon and a pivot bar member extending between said lugs for pivotal attachment to said mounting head, at least one hydraulic cyinder attached at one end to the second platform and having a rod pivotally attached to the mounting head for pivoting the mounting head about the pivot bar.

* * * * *

UNITED STATES PATENT AND TRADEMARK OFFICE

CERTIFICATE OF CORRECTION

PATENT NO. : 4,861,112

DATED : August 29, 1989

INVENTOR(S) : Louis A. Grant

It is certified that error appears in the above-identified patent and that said Letters Patent is hereby corrected as shown below:

Column 3 Line 11 "l" should read --I--.

Column 3 Line 13 "mounmting" should read --mounting--.

Column 3 Line 32 "area" should read --rear--.

Column 4 Line 18 "THe brakcet" should read --The bracket--.

Column 6 Line 31 "5" should read --S--.

Column 6 Line 37 "5" should read --S--.

Column 6 Line 56 "retraced" should read --retracted--.

Column 7 Line 17 "diggin" should read --digging--.

Column 7 Lines 22-23 "mmotor" should read --motor--.

UNITED STATES PATENT AND TRADEMARK OFFICE

CERTIFICATE OF CORRECTION

PATENT NO. : 4,861,112

DATED : August 29, 1989

INVENTOR(S) : Louis A. Grant

It is certified that error appears in the above-identified patent and that said Letters Patent is hereby corrected as shown below:

Column 7 Line 28 "calbe" should read --cable--.

Claim 2 Line 9 Column 8 "travelling" should read --traveling--.

Claim 5 Line 42 Column 8 "receiving" should read --received--.

Claim 5 Line 43 Column 8 "movment" should read --movement--.

Claim 14 Line 13 Column 10 "cyinder" should read --cylinder--.

Signed and Sealed this

Seventh Day of August, 1990

*Attest:*

HARRY F. MANBECK, JR.

*Attesting Officer*

*Commissioner of Patents and Trademarks*